United States Patent [19]

Koontz et al.

[11] 4,153,523

[45] May 8, 1979

[54] CONTINUOUS ELECTROCHEMICAL PROCESSING APPARATUS

[75] Inventors: Donald E. Koontz, Summit; Dennis R. Turner, Chatham Township, Morris County, both of N.J.

[73] Assignee: Bell Telephone Laboratories, Incorporated, Murray Hill, N.J.

[21] Appl. No.: 902,896

[22] Filed: May 4, 1978

[51] Int. Cl.[2] ..... C25F 3/16; C25F 7/00; C25D 5/02

[52] U.S. Cl. ..... 204/129.6; 204/15; 204/207; 204/224 R

[58] Field of Search ..... 204/15, 224 R, 206, 204/28, 129.6, 129.7, 207

[56] References Cited

U.S. PATENT DOCUMENTS

| | | | |
|---|---|---|---|
| 1,899,449 | 2/1933 | Wallsten | 204/207 |
| 2,372,599 | 3/1945 | Nachtman | 204/206 |
| 3,657,097 | 4/1972 | Baldock et al. | 204/224 R |
| 3,878,062 | 4/1975 | Grimaldi et al. | 204/224 R |
| 4,029,555 | 6/1977 | Tezuka et al. | 204/206 |
| 4,032,414 | 6/1977 | Helder et al. | 204/224 R |
| 4,033,832 | 7/1977 | Sterling et al. | 204/224 R |
| 4,083,755 | 4/1978 | Murata | 204/15 |

*Primary Examiner*—T. M. Tufariello
*Attorney, Agent, or Firm*—Walter G. Nilsen

[57] ABSTRACT

An apparatus and process are described in which a multiple continuous electrochemical procedure is carried out on a metallic strip. Included in this procedure are both cleaning and electropolishing steps prior to plating on the metallic strip. Particularly important is the design of the various electrochemical processing cells so that continuous processing may be carried out on a continuous moving metal strip. Also, compatibility with other electrochemical and chemical processes carried out on the continuous strip line is desirable.

17 Claims, 11 Drawing Figures

CONTINUOUS ELECTROCHEMICAL PROCESSING APPARATUS

BACKGROUND OF THE INVENTION

The invention involves an electrochemical processing procedure and apparatus.

Electrochemical processing procedures are extensively used in modern technology particularly in circuit fabrication and manufacture of electrical devices such as connectors, relay contacts, switch contacts, etc. Bulk processing procedures are often used and yield perfectly good results. It is desirable to improve these procedures in various ways. More rapid processing is highly desirable economically, particularly for high volume items. More exact control of the electrochemical process is highly desirable to reduce the number of rejected components and to insure high reliability and long life. Reduced volume of various bath solutions reduces costs of the process.

SUMMARY OF THE INVENTION

The invention is a process and apparatus for continuous, multi-step processing on a metallic strip. The apparatus is a succession of processing cells, including cleaning cells, electropolishing cells, rinsing cells and plating cells. These cells are located successively on a strip line plating machine. Processing takes place as the continuous metallic strip moves down the strip line plating machine. The entire strip line plating machine is covered with domes so that it is not vented into the air but instead forms a closed system. Included in the apparatus is an electropolishing cell. Design of the electroplating cell and electropolishing processing parameters are particularly important so as to insure compatibility with other chemical steps in the continuous electrochemical process. Cell width and cross-section are generally small, (typically less than 3 inches height and 3 inches width) so as to permit high parallel flow rates. Generally, for polishing, it is found desirable to minimize parallel flow rates between strip line and electropolishing solution. For this reason, the electropolishing solution is flowing in the same direction as the moving strip line. Polishing solution advantageously used in this process is phosphoric acid with small amounts of water and aluminum ion. Some polishing procedures are described by C. L. Faust in U.S. Pat. No. 2,366,714, issued Jan. 9, 1945. Electrodes are located on each side of and parallel to the strip line. A damming arrangement is used to fix the level of the electropolishing solution. Particularly significant is the arrangement used to transfer current from power supply to metal strip being processed. In this arrangement the polishing cell is followed by a blow-off section which removes excess polution by use of an air stream. This blow-off section contains deflection plates which concentrates the air stream onto the metal strip being processed. Excess solution is returned to the reservoir. Rinse cells are also used which contain means for concentrating liquid spray onto the metal strip and optionally by a rinse cell. Typically, other cells follow the electropolishing cell which carry out various electrochemical procedures such as plating, etc. One typical arrangement has first a nickel plating cell, then a flash gold plating cell and then a hard gold plating cell. These various cells may have blow-off sections and rinse cells interposed at various locations along the strip line to minimize contamination between cells. All cells are advantageously equipped with a tight-fitting cover so that cells remain closed to the outside atmosphere. This minimizes evaporation and contamination problems. The cover also prevents mixing of the atmosphere of one cell with another cell. It is highly advantageous to use this apparatus for processes of fabricating pins for connectors because of the rapid throughput, convenience of arranging pins in a strip line and ease of concentrating plating (gold plating, for example) in limited areas of the pin. Real time process control is also highly advantageous. Plating or processing can be carried out on both sides simultaneously or one side at a time. Processing or plating can be changed from one side to another without changing equipment or interrupting operation.

DETAILED DESCRIPTION

Figure 1:
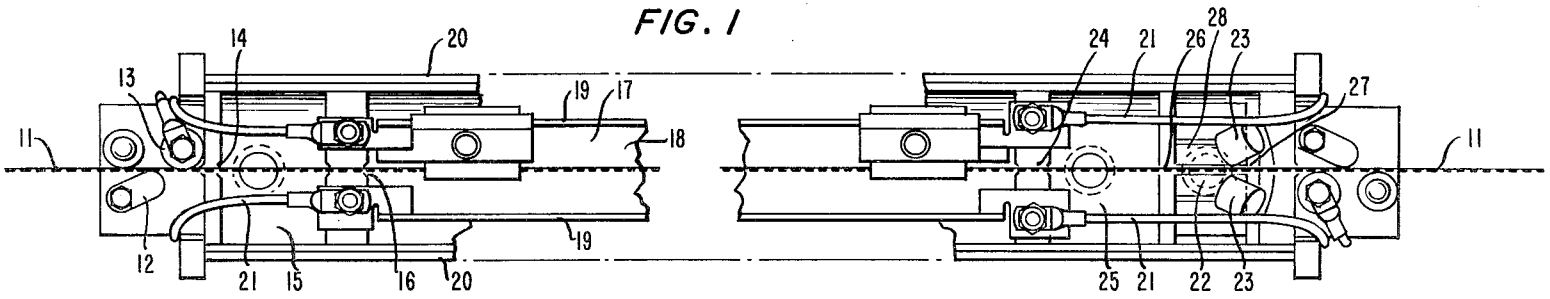
FIG. 1 shows a top view of the electropolishing cell.

An understanding of the invention can conveniently be obtained by a description of the drawings. FIG. 1 shows a top view of the electropolishing cell 10 comprising generally a long narrow container with metallic strip 11 entering the electropolishing cell through an electrical contact 12 and 13. The electrical contact arrangement comprises a stationary member 12 generally rounded-off at the end which is pressed up against the strip line and two round members 13 located on the other side of the strip line and before and after the stationary member 12. Although various conductive materials (generally metals) may be used to make the contacts, titanium is highly advantageous because of freedom from corrosion, relatively low cost and ease of fabrication. This electrical contact arrangement is used to pass current between metal strip and one polarity of a power supply. Generally, the entire metal strip is kept at the same potential and the counter electrodes in each cell biased either positive or negative for electropolishing or plating.

The strip line then passes through a small narrow slotted section 14 into a small spill-over chamber 15, then through another small narrow slotted section 16 and into the main part of the electropolishing cell 17 containing the place for electropolishing solution 18 and electrodes 19. These electrodes are in the form of long flat plates extending over most of the length of the cell and parallel to both the strip line and cell walls 20. The electrodes can be made of a variety of conductive materials including titanium but copper is preferred because of good conductivity. Wires 21 are used to carry electrical energy from power supply to the electrodes. The strip line exits the main part of the electropolishing cell through a small narrow slot 24 into a spill-off chamber 25. The metal strip exits the spill-off chamber 25 through another small narrow slot 26. A blow-off section 22 is used to blow off most of the electroplating solution from the strip line prior to leaving the cell. Two nozzles 23 are used to direct a gaseous stream (usually air) onto the strip line 11 so as to remove electrolyte solution. Deflection plates 28 are located on each side of the metal strip, generally parallel to the length of the strip and inclined inward toward the strip as the plates extend downward. These deflection plates concentrate the gaseous stream onto the strip and greatly increase the efficiency of solution removal. The metal strip line exits through a small opening 27 in the blow-off section and then to subsequent processing cells.

Figure 2:
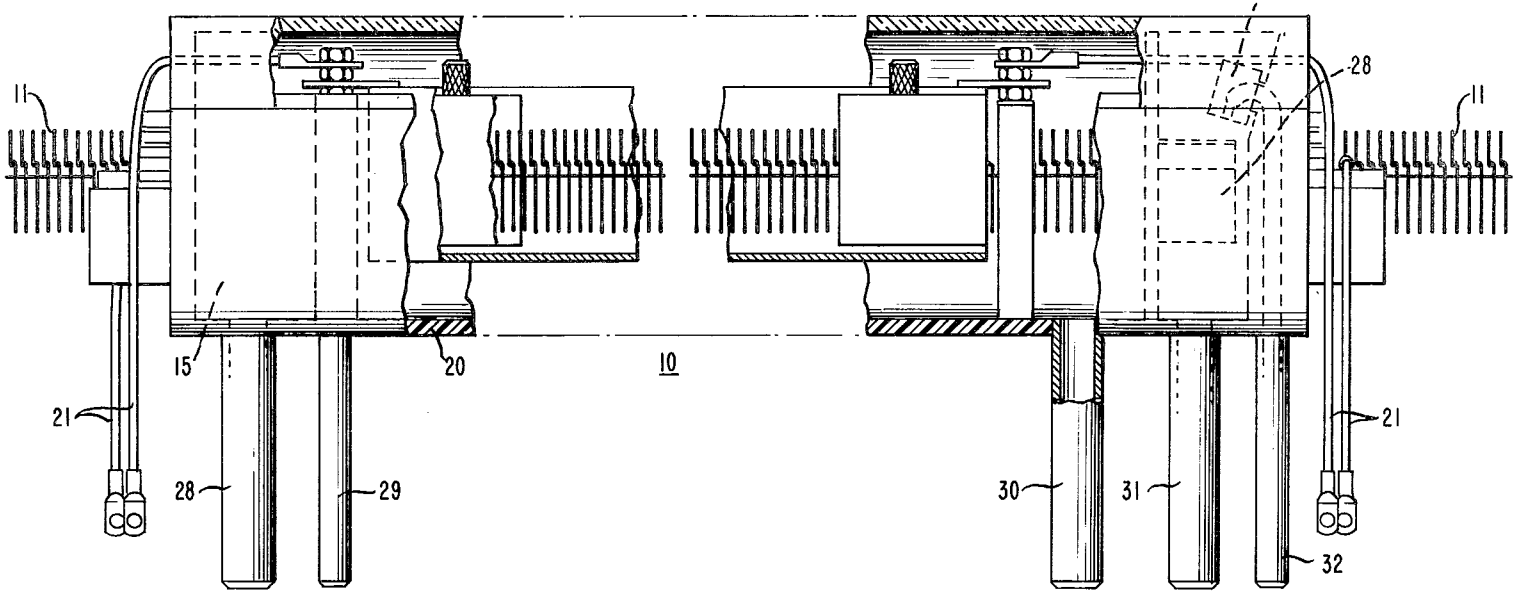
FIG. 2 shows a side view of the electropolishing cell.

FIG. 2 shows a side view of the electropolishing cell 10 showing metal strip 11 and drain-off or exit tube 28 of the spill-off chamber 15 and wires 21 used to carry current to the electrodes 19. The entrance tube 29 for the electropolishing solution is also shown together with electrode 19 and cell wall 20. Also shown is the exit tube 30 for the spill-off chamber 25 and the exit tube 31 for the blow-off chamber 22. The exit tubes (28, 30, 31) convey electropolishing solution to a reservoir from which it is recirculated by pumping electropolishing solution up through the entrance tube 29. The tube 32 is used to convey gas (usually air) for the blow-off nozzle 23. Also shown are the deflection plates 28 which are critical in concentrating the air stream onto the metal strip and effectively remove solution.

Figure 3:
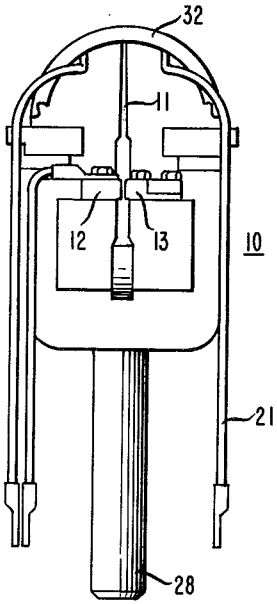
FIG. 3 shows an end view of the entrance end of the polishing cell.

FIG. 3 shows an end view of the entrance end of the polishing cell with electrical 21 and exit tube 28. Also shown is the metal strip 11, electrical contacts 12 and 13 and cell cover 32.

Figure 4:
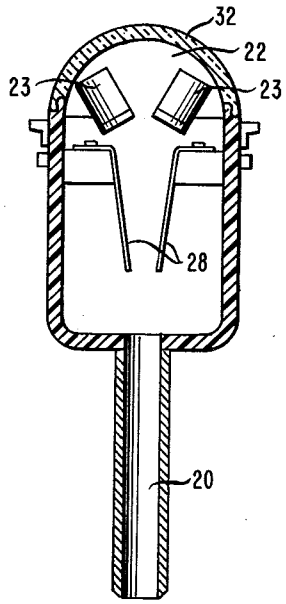
FIG. 4 shows an end view of the blow-off section following the electropolishing cell.

FIG. 4 shows an end view of the blow-off section 22 with blow-off nozzles 23 and deflecting plates 28 used to concentrate the air stream on the metal strip 11. Also shown is the exit tube 30 and cell cover 32.

Figure 5:
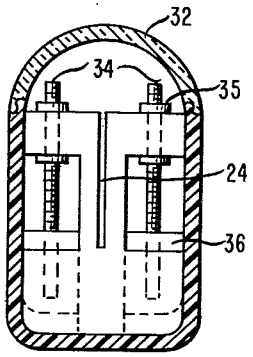
FIG. 5 shows an end view (exit end) of the electropolishing cell including a view of the damming arrangement used to fix the level of electrochemical solution.

FIG. 5 shows an end view of the main part of the electropolishing cell. It includes small narrow slot 24 through which the metal strip 11 moves. Also shown is a damming device with screws 34, lock nuts 35 and dam 36. The height of this dam controls the level of electropolishing solution in the main part of the electropolishing cell. Electropolishing solution spills over the dam and is returned to a reservoir from which it is subsequently recirculated by pump.

Figure 6:
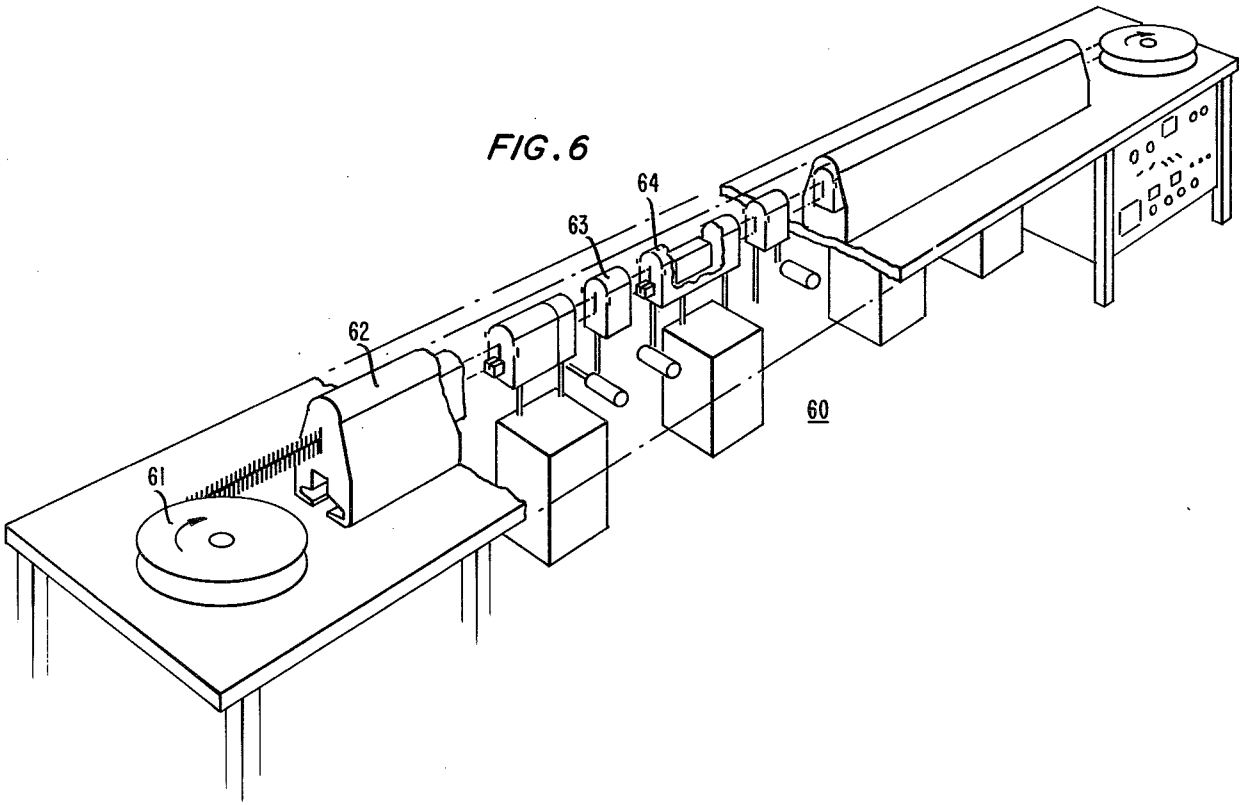
FIG. 6 shows a perspective view of the strip line plating machine.

FIG. 6 shows a perspective view of a strip line plating machine 60 with a spool of metal strip 61 which is fed into electropolishing cell 62. Also shown are rinse cells 63 and various plating cells 64.

Figure 7:
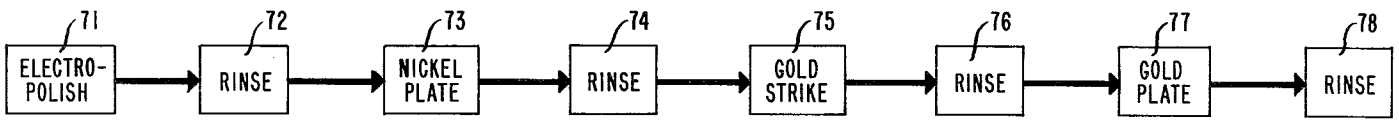
FIG. 7 shows a block diagram of the strip line plating machine.

FIG. 7 shows in block diagram 70 a typical strip line processing apparatus with electropolishing cell 71, rinse cell 72, nickel plating cell 73, rinse cell 74, gold strike cell 75, rinse cell 76, gold plate cell 77 and rinse cell 78.

Figure 8:
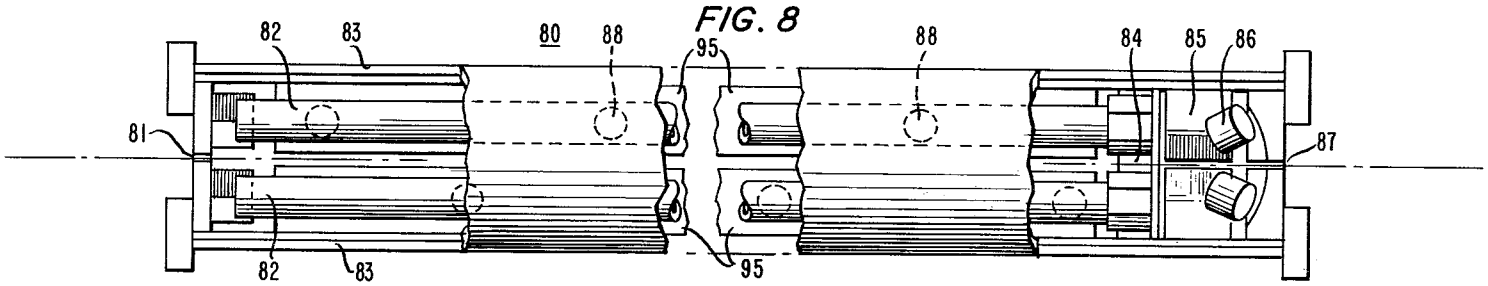
FIG. 8 shows a top view of a rinse cell.

FIG. 8 shows a top view of a rinse cell 80 showing a small narrow slot 81 through which the metal strip enters the rinse cell. Rinsing is provided by a spray of preferably hot water from nozzles 88 attached to tubes 82 running parallel to the cell walls 83. The nozzles 88 are pointed downward toward the metal strips. Although tubes and nozzles may be made of many suitable materials, titanium is preferred for the tube because of rigidity and chemical inertness and chloropolyvinylchloride for the nozzles because of chemical inertness. Parallel walls on either side of the metal strip and displaced parallel to the metal strip are used to concentrate the water spray on the metal strip. The metal strip exits through a small narrow slot into a blow-off section 85 with two nozzles 86 used to direct a gaseous stream (usually air) into the strip line. The metal strip then exits through a small slot 87.

Figure 9:
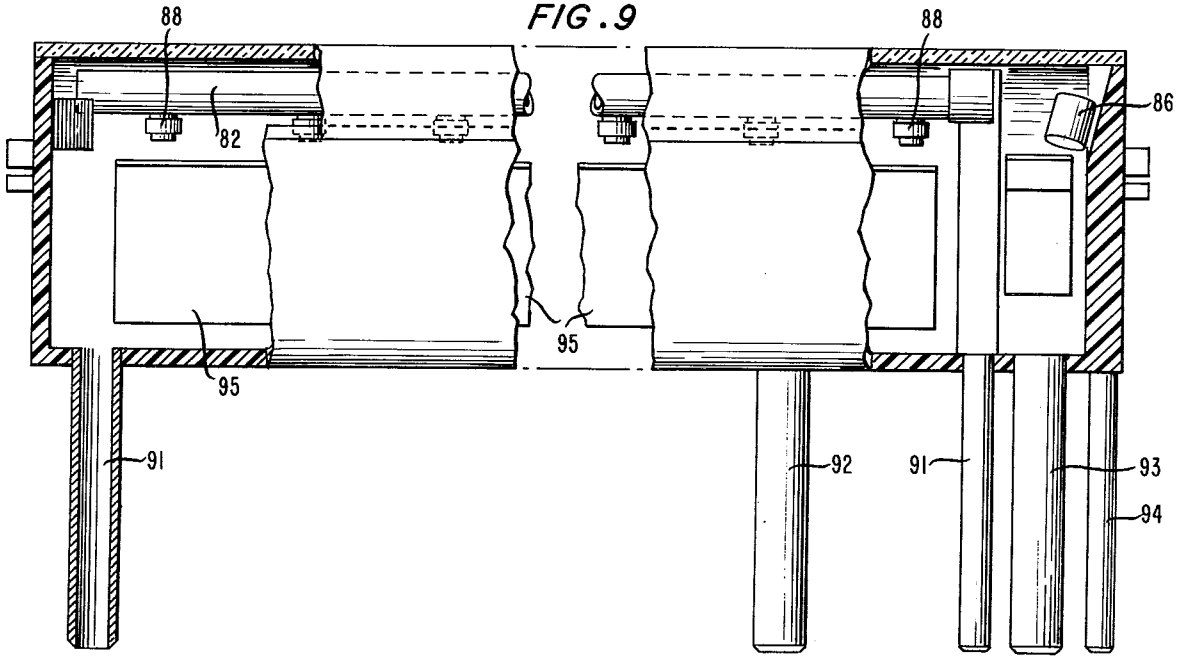
FIG. 9 shows a side view of a rinse cell.

FIG. 9 shows a side view of a rinse cell 80. Shown are the tubes used for the water spray 82 and nozzle 86 used for the air spray. Also shown is the water inlet tube 91, water exit tubes 92 and 93 and the air inlet tube 94.

Figure 10:
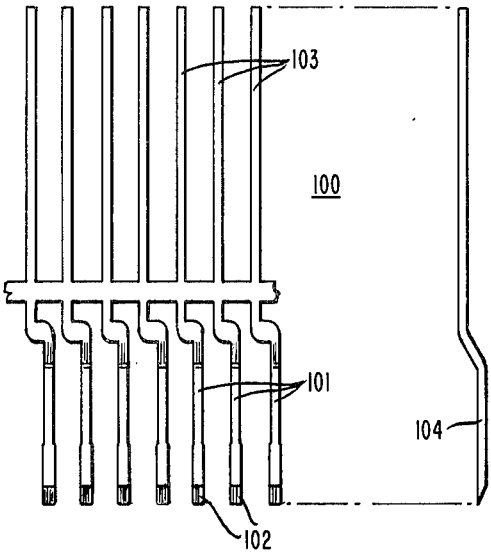
FIG. 10 shows a strip line of connector pins advantageously plated in accordance with the invention.

FIG. 10 shows a portion of the metal strip 100 used to make connector pins 101 with plated portions 102 on the bottom and the plated portions 103 on the top. Also shown is a side view of an individual connector pin 104 made in accordance with the invention.

Figure 11:
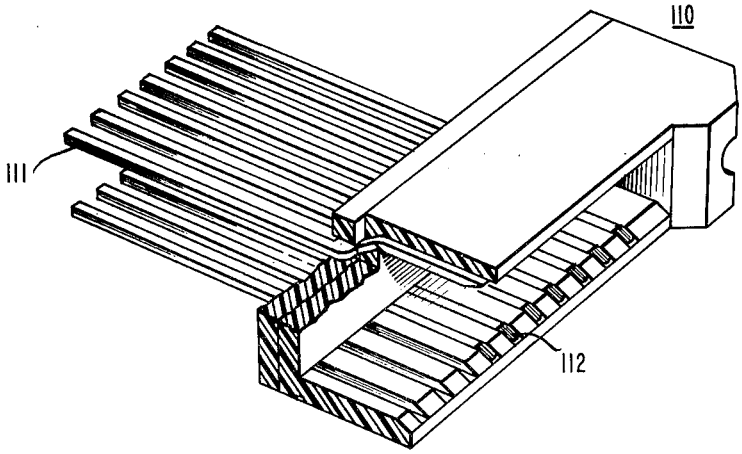
FIG. 11 shows a connector made from pins plated in accordance with the invention.

FIG. 11 shows a cutaway view of a connector 110 with connector pins 111. The figure also shows the portion of the connector pins 112 located inside the connector.

Highly advantageous is a process for making electrical connectors from pins made on the apparatus described above. Pins are required to be exposed to a variety of electrochemical processes including cleaning, electropolishing, different electroplating procedures, such as nickel plating, flash gold plating, hard gold plating, etc. In addition, continuous strips (unpunched) may also be processed. Particularly advantageous is immediate sequential processing since surfaces are not contaminated between processing steps and large amounts of inventory need not be built up between processing steps. Further, pins are rapidly produced, with high yield and low cost. Process control is exceptionally good because rapid recirculating bath solutions can be temperature stabilized easily and rapidly analyzed to insure good compositional control. The process is particularly convenient for real time control, including pH measurement, temperature control, etc., as processing is carried out. It permits many economic advantages such as high speed processing, reduced labor, reduced inventory of chemicals, reduced venting costs, time-shared processing control, common support systems for all processing steps and flexibility in exchanging processing cells for improved processing or adding additional processing steps.

We claim:

1. An apparatus for continuous electrochemical processing on a continuous metallic strip using a plurality of processing steps carried out in a plurality of processing cells including an electropolishing processing cell, said electropolishing cell comprising a long narrow container comprising:

(a) means for making electrical contact to the metallic strip, said means comprising a stationary rectangular member generally rounded-off at the end and pressing against the metal strip line and two stationary round members located on the other side of the strip line and located before and after the stationary rectangular member, said rectangular and round members made of conducting material;

(b) a first slotted section for admitting metal strip into an entrance spill-over chamber, said slotted section being deep enough to admit at least a portion of the metal strip into the electropolishing processing cell and wide enough to provide clearance for the metal strip;

(c) a first spill-over chamber with a drainage tube to convey electropolishing solution to an electropolishing solution reservoir;

(d) a second slotted section for admitting the metal strip into a main part of the electropolishing cell said slotted section being deep enough to admit at least a portion of the metal strip into the electropolishing processing cell and wide enough to provide clearance for the metal strip;

(e) a main part of the electropolishing cell comprising electrodes located approximately parallel to the metal strip and side walls of the electropolishing cell means for conducting current to the electrodes, a tube for admitting electropolishing solution;

(f) a third slotted section for admitting the metal strip into a second spill-over chamber said slotted section being deep enough to admit at least a portion of the metal strip into the electropolishing processing cell and wide enoug to provide clearance for the metal strip;

(g) a second spill-over section containing a drainage tube for draining electropolishing solution into a reservoir;

(h) a fourth slotted section which is deep enough to admit at least a portion of the metal strip into the electropolishing processing cell and wide enough to provide clearance for the metal strip;

(i) a blow-off section with two gas nozzles located approximately symmetric on each side of the space provided for the metal strip said blow-off section provided with a drainage tube to convey electropolishing solution to a reservoir and passageways to convey gas to the gas nozzles said blow-off section equipped with deflection plates, one on each side and approximately parallel to the metal strip along its length and inclined inward toward the metal strip as the deflection plate extends downward; and (j) a fifth slotted section which is deep enough to admit at least a portion of the metal strip into the electropolishing cell and wide enough to provide clearance for the metal strip.

2. The apparatus of claim 1 in which means for making electrical contact to the metallic strip comprises:

(a) a stationary metallic section positioned so that it can be in contact with and exerting pressure on the metallic strip; and (b) a revolving metallic section, located on the opposite side of the space provided for the metallic strip and displaced along the space provided for the metallic strip a distance of one quarter to two inches and in such a position that the revolving metallic section can be in contact with the metallic strip and can exert pressure against the metallic strip.

3. The apparatus of claim 1 in which the slotted section extends between 1.7 and 2.3 inches below the sides of the long narrow container and is between 1/16 and ¼ inches wide.

4. The apparatus of claim 1 in which provision is made to circulate electropolishing solution in the main part of the electropolishing cell with flow in the same direction as the movement of the metallic strip.

5. The apparatus of claim 1 in which the metallic strip comprises at least 50 percent by weight copper.

6. The apparatus of claim 5 in which the metallic strip consists essentially of 9 weight percent nickel, two weight percent tin, remainder copper.

7. The apparatus of claim 1 in which the level of the electropolishing solution is controlled by a damming device located in the wall between the main part of the electropolishing cell and the second spill-over section with one damming device on each side of the third slotted section, said damming device comprising a wall which moves vertically up and down by means of a threaded rod so as to prevent electropolishing solution below a desired level from spilling into the second spill-over section.

8. The apparatus of claim 7 in which the threaded rods have lock nuts so as to lock the threaded rods in place.

9. The apparatus of claim 1 in which the blow-off section includes deflection plates which deflect the gaseous stream from the two gas nozzles inward toward the place for the metal strip.

10. The apparatus of claim 1 in which the electropolishing cell is followed by a rinse cell.

11. The apparatus of claim 10 in which the rinse cell comprises (a) an entrance slotted section for admitting the metal strip into the rinse cell, said entrance slotted section being deep enough to admit at least a portion of the metal strip into the rinse cell and wide enough to provide clearance for the metal strip;

(b) two tubes located along the length of the rinse cell and equipped with nozzles so that water sprays towards the place for the metal strip;

(c) deflection plates located on each side of the metal strip, parallel to the length of the metal strip and slightly inclined toward the strip as the deflection plates extend downward so as to concentrate rinse spray onto the metal strip;

(d) a rinse exit slotted section said rinse exit slotted section being deep enough to admit at least a portion of the metal strip into the rinse cell and wide enough to provide clearance for the metal strip; and (e) a blow-off section with gas nozzles used to blow off liquid from the metal strip.

12. The apparatus of claim 11 in which the tubes consist essentially of titanium and the nozzles consist essentially of chloropolyvinylchloride.

13. The apparatus of claim 1 in which the metal strip is taken off a spool at the entrance to the plating apparatus and wound onto a spool at the exit of the apparatus.

14. The apparatus of claim 1 in which the electropolishing cell is followed by a nickel plating cell, a gold strike cell and a gold plating cell in an entirely closed system.

15. The apparatus of claim 1 in which the metal strip comprises connector pins for an electrical connector.

16. A process for making electrical connectors comprising the step of carrying out a chemical procedure on a metal strip comprising pins for the electrical connector using an apparatus for continuous electrochemical processing on a continuous metallic strip using a plurality of processing steps carried out in a plurality of processing cells including an electropolishing processing cell, said electropolishing cell comprising a long narrow container comprising:

(a) means for making electrical contact to the metallic strip said means comprising a stationary rectangular member generally rounded-off at the end and pressing against the metal strip line and two stationary round members located on the other side of the strip line and located before and after the stationary rectangular member, said rectangular and round members made of conducting material.

(b) a first slotted section for admitting metal strip into an entrance spill-over chamber, said slotted section being deep enough to admit at least a portion of the metal strip into the electropolishing processing cell and wide enough to provide clearance for the metal strip;

(c) a first spill-over chamber with a drainage tube to convey electropolishing solution to an electropolishing solution reservoir;

(d) a second slotted section for admitting the metal strip into a main part of the electropolishing cell said slotted section being deep enough to admit at least a portion of the metal strip into the electropolishing processing cell and wide enough to provide clearance for the metal strip;

(e) a main part of the electropolishing cell comprising electrodes located approximately parallel to the metal strip and side walls of the electropolishing cell means for conducting current to the electrodes, a tube for admitting electropolishing solution;

(f) a third slotted section for admitting the metal strip into a second spill-over chamber said slotted section being deep enough to admit at least a portion of the metal strip into the electropolishing processing cell and wide enough to provide clearance for the metal strip;

(g) a second spill-over section containing a drainage tube for draining electropolishing solution into a reservoir;

(h) a fourth slotted section which is deep enough to admit at least a portion of the metal strip into the electropolishing processing cell and wide enough to provide clearance for the metal strip;

(i) a blow-off section with two gas nozzles located approximately symmetric on each side of the space provided for metal strip said blow-off section provided with a drainage tube to convey electropolishing solution to a reservoir and passageways to convey gas to the gas nozzles said blow-off section equipped with deflection plates, one on each side and approximately parallel to the metal strip along its length and inclined inward toward the metal strip as the deflection plate extends downward; and (j) a fifth slotted section which is deep enough to admit at least a portion of the metal strip into the electropolishing cell and wide enough to provide clearance for the metal strip.

17. The process of claim 16 in which the plurality of cells form an entirely closed system.

* * * * *